United States Patent [19]

Buckley

[11] Patent Number: 4,541,171

[45] Date of Patent: Sep. 17, 1985

[54] METHOD OF MAKING AN ELECTRICAL TRANSFORMER

[75] Inventor: Richard D. Buckley, Watkinsville, Ga.

[73] Assignee: Westinghouse Electric Corp., Pittsburgh, Pa.

[21] Appl. No.: 604,668

[22] Filed: Apr. 27, 1984

[51] Int. Cl.[4] ..... H01F 41/06

[52] U.S. Cl. ..... 29/605; 29/423; 264/317

[58] Field of Search ..... 29/602 R, 605, 423; 336/60, 61; 264/317, 221

[56] References Cited

U.S. PATENT DOCUMENTS

| | | | |
|---|---|---|---|
| 240,459 | 4/1881 | Quinby | 264/317 X |
| 4,337,569 | 7/1982 | Pierce | 29/605 |
| 4,503,605 | 3/1985 | Buckley | 29/605 |

*Primary Examiner*—Carl E. Hall

*Attorney, Agent, or Firm*—Donald R. Lackey

[57] ABSTRACT

A method of forming cooling ducts in the windings of a liquid cooled electrical transformer without adding permanent duct formers to the winding, and without requiring an additional manufacturing step to remove duct formers. Plastic tubes dissolvable in the liquid dielectric are utilized as the duct formers. Thermal siphon flow of the liquid through the tube openings when the transformer is energized dissolves the tubes and enlarges the cooling ducts to the outside dimensions of the tubes.

5 Claims, 6 Drawing Figures

FIG. 4
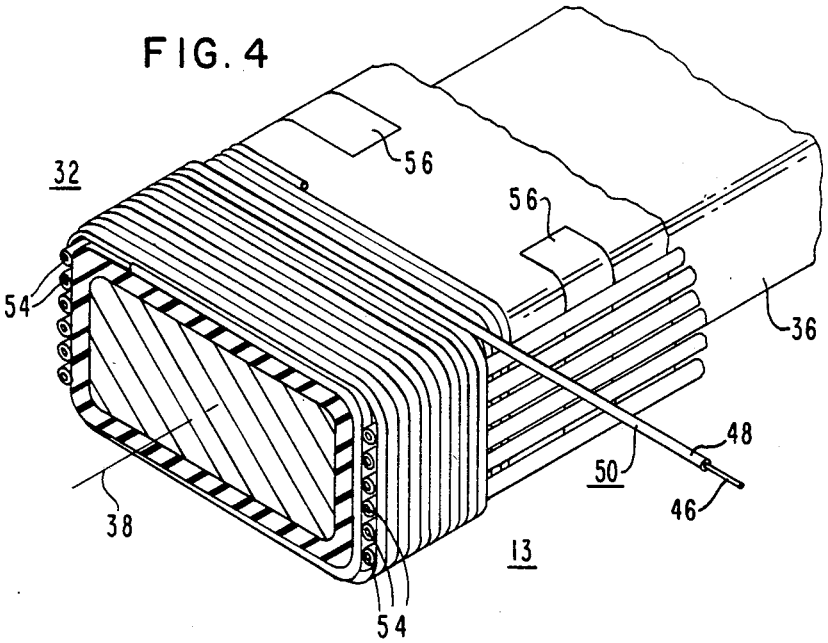
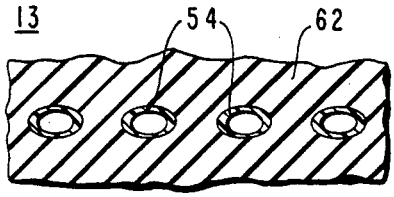
FIG. 5A
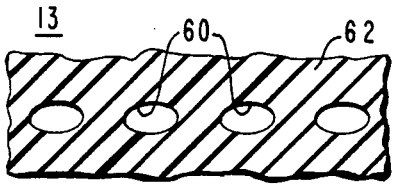
FIG. 5B

METHOD OF MAKING AN ELECTRICAL TRANSFORMER

BACKGROUND OF THE INVENTION

1. Field of the Invention

The invention relates in general to electrical transformers, and more specifically to electrical transformers cooled by a liquid dielectric.

2. Description of the Prior Art

Electrical transformers cooled by a liquid dielectric, such as mineral oil, have cooling ducts formed through the transformer windings in order to direct the liquid as closely as possible to the source of the heat, i.e., the conductor turns. It is conventional to place solid spacers between the turn layers of transformers insulated primarily with cellulosic insulation, with the spacers, which become a permanent part of the winding, supporting the turns and creating gaps or ducts for coolant flow.

In my co-pending application Ser. No. 524,227, filed Aug. 18, 1983, now U.S. Pat. No. 4,503,605, entitled "Cellulose-Free Transformer Coil and Method", which is a continuation of application Ser. No. 264,151, filed May 15, 1981, now abandoned, there is disclosed new and improved cellulose-free winding structures, and methods of constructing such windings, in which the insulation starts out as a liquid resinous insulation and is solidified. The methods disclosed control the formation and size of the voids in the resulting winding structure, such as those due to polymerization shrinkage. My co-pending application discloses constructing an electrical winding in a substantially continuous operation, including the steps of applying liquid resinous insulation to a substrate, quickly solidifying the liquid resin, and immediately applying one or more conductor turns to the just-solidified resin. Cooling ducts are formed by placing solid elongated strips of plastic into the electrical winding as it is being wound. Prior to placing the winding in a transformer tank, the plastic is melted, with the resulting voids forming the cooling ducts.

SUMMARY OF THE INVENTION

Briefly, the present invention relates to new and improved methods of constructing electrical windings, which methods may be used with, or in place of, certain of the methods disclosed in my hereinbefore-mentioned commonly assigned patent application. The present invention retains the advantages of the methods disclosed in my co-pending patent application, including the formation of cellulose-free insulation in situ while an electrical winding is being constructed on a mandrel or coil former at commercial winding speeds. The substantially void-free solid insulation produced by such methods possesses a higher and more uniform electrical breakdown strength, a greater mechanical strength, and improved thermal conductivity.

The present invention specifically relates to the formation of cellulose-free electrical windings having cooling ducts formed therein for the flow of a liquid cooling dielectric. Instead of utilizing said solid strips of plastic, as disclosed in my co-pending application, plastic tubes are strategically placed in the electrical winding as it is being wound, with the plastic material being selected such that it dissolves in the liquid dielectric without deleteriously affecting the electrical or cooling characteristics of the liquid. The opening in each tube is selected such that the liquid will flow therethrough by thermal siphon when the transformer is energized, and the outside dimensions of each tube are selected according to the size of the desired cooling duct. Thus, the cooling ducts of the desired cross-sectional dimension are automatically formed, without the necessity of an additional manufacturing step. Energization of the transformer during test and/or during actual usage thereof, will heat the liquid dielectric and start its flow through the openings in the tubes. The heated liquid dissolves each tube, starting at its inner wall and progressing outwardly, until the complete tube is dissolved, leaving a cooling duct of the desired cross-sectional configuration and dimensions.

BRIEF DESCRIPTION OF THE DRAWINGS

The invention may be better understood, and further advantages and uses thereof more readily apparent, when considered in view of the following detailed description of exemplary embodiments, taken with the accompanying drawings, in which:

FIG. 4 is a perspective view which illustrates the continued formation of the winding being formed by the steps shown in FIGS. 2 and 3, including winding an electrical conductor about the plastic tubes added in the step of FIG. 3, to form a layer of conductor turns about the plastic tubes;

FIG. 5A is an enlarged, fragmentary, cross-sectional view of the coil portion of the transformer shown in FIG. 1, taken between and in the direction of arrows V—V, with this view illustrating the coil before the plastic tubes have been dissolved; and FIG. 5B is a view similar to that of FIG. 5A, except illustrating the transformer coil after the plastic tubes have been dissolved.

DESCRIPTION OF THE PREFERRED EMBODIMENTS

Figure 1:
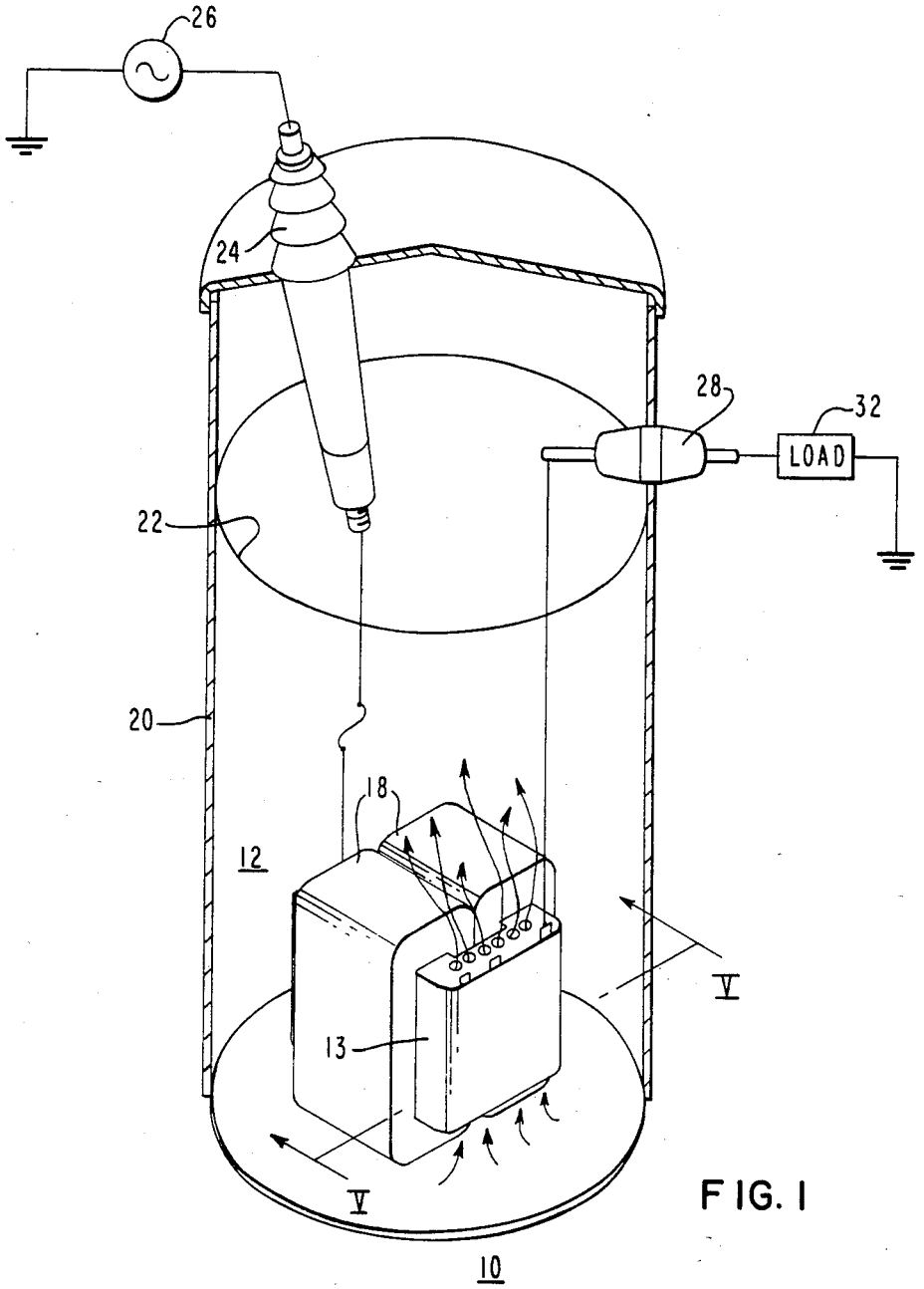
FIG. 1 is a perspective view of an electrical transformer, shown partially cut away, which is constructed according to the new and improved methods of the invention.

FIG. 1 is a perspective view, with parts cut away, of an exemplary distribution type transformer 10 having liquid cooled windings constructed according to the new and improved methods of the invention. Transformer 10 includes a core-coil assembly 12 which includes a coil 13 comprising high and low voltage windings disposed in inductive relation with a magnetic core 18. The core-coil assembly 12 is disposed in a tank 20, and it is immersed in a liquid cooling medium 22. Transformer oil may be used for the liquid cooling medium, but if the windings are of the type which do not require oil for electrical insulating purposes, other liquids selected primarily for their cooling characteristics may be used. The high voltage winding is connected to a high voltage bushing 24 for energization by a source 26 of electrical potential, and the low voltage winding is connected to low voltage bushings, such as bushing 28, for connection to a load 32. Each winding of coil 13 may be constructed in sections, which are electrically connected together, or only one section per winding may be used, as desired. While it has been conventional for the low voltage winding to be physically located next to the magnetic core 18, in a low-high (L-H) arrangement or in a low-high-low (L-H-L) arrangement, it is to be understood that the high and low voltage windings may be in any desired order. The low voltage winding may be constructed of sheet conductor, such as aluminum sheet insulated with a thin resinous layer of insulation on each side thereof, or it may be formed of wire commonly called strap. The high voltage winding may be constructed of flattened round wire, pre-insulated with a suitable insulating material such as enamel, but other cross-sectional configurations may be used, such as round or rectangular.

Figure 2:
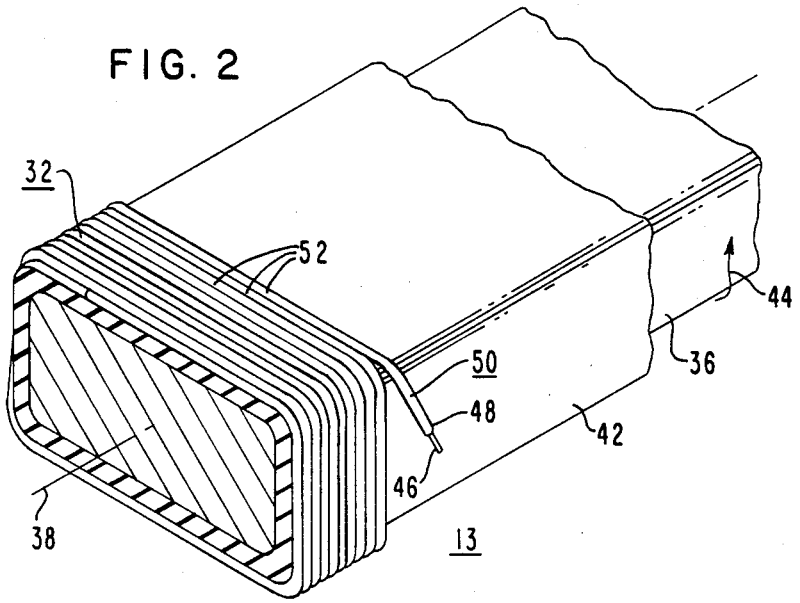
FIG. 2 is a perspective view which illustrates a step of winding an electrical conductor about a mandrel or other coil support, to provide a winding layer having a plurality of conductor turns.

FIG. 2 is a perspective view illustrating a first step of a method of forming cooling ducts in a winding of transformer 10. For purposes of example, the invention will be described relative to the construction of a winding 32 of coil 13 constructed of wire, and it will be described with reference to a rotating mandrel or coil support 36 which has a rotational axis 38. It would also be suitable for the mandrel 36 to be stationary, with supply stations rotating about the mandrel. The rotational axis of mandrel 36 is coaxial with the center line of the resulting coil 13.

Coil 13 requires ground wall insulation 42 which will be disposed between the innermost winding, which will be winding 32 in this example, and the magnetic core 18 shown in FIG. 1. The ground wall insulation 42 may be provided by disposing a pre-manufactured winding tube on mandrel 36, or it may be built up of a plurality of thin layers of liquid insulation, with each layer of insulation being applied and quickly solidified, such as by ultraviolet light, before the next layer is applied, as described in detail in my hereinbefore-mentioned commonly assigned patent application Ser. No. 524,227. In order the simplify the description, application Ser. No. 524,227 is hereby incorporated into the present application by reference, and the details of forming a non-cellulosic transformer will not be described. If ground insulation 42 is formed in situ as mandrel 36 is rotated, it may be formed of the same liquid resin used to form the insulation for winding 32. A suitable mold release material may be sprayed or otherwise applied to the mandrel 36 prior to the building up of the ground wall insulation 42 with liquid resinous insulation. When the plurality of thin layers of solidified resinous insulation have been applied to achieve the desired thickness of ground wall insulation 42, winding 32 may be wound on insulation 42. Mandrel 36 is rotated in the direction of arrow 44, about is rotational axis 38. A conductive strand 46, such as copper or aluminum wire suitably insulated with enamel 48, hereinafter referred to as wire 50, is used to construct winding 32. Wire 50 may have any desired cross-sectional configuration, such as round or rectangular, with flattened round wire being excellent because of its good space factor. Wire 50 is placed into position on the insulative substrate, i.e., the insulation 42 in the present example, and it is suitably secured adjacent one axial end of mandrel 36. Mandrel 36 is then rotated about its axis 38 to draw wire from a supply reel (not shown) to form conductor turns 52, as shown in FIG. 2. Turns 52 are formed side-by-side until a layer of turns have been completed. Another layer of turns may be formed directly upon the first layer, with the turns of the next layer usually progressing in the opposite axial direction from the turns of the preceding layer.

When the desired number of turn layers has been formed, mandrel 36 is stopped momentarily for the provision of cooling ducts. Instead of applying solid plastic strips to the outer surface of a turn layer of coil 32, as described in my co-pending application, non-collapsible plastic tubing 52 is used. The non-collapsible plastic tubing 54 is selected such that it will dissolve in the liquid 22 when the coil 12 is immersed in the liquid and electrically energized. In addition to dissolving in liquid 22, the plastic selected must not adversely affect the cooling or electrical insulating characteristics of liquid 22. If liquid 22 is transformer oil, polyethylene tubing is excellent. A plastic tube of any cross-sectional configuration which will not collapse during coil winding and which will provide a flow path for the liquid coolant may be used. For example, polyethylene tubing having an O.D. of 0.25 inch (0.635 cm) and a 0.040 inch (0.102 cm) wall thickness is excellent. The tubing may be thermally flattened on two sides, if desired, so that the maximum radial dimension added to the coil layers or any one grouping of plastic tubes is about 0.125 inch (0.317 cm). The actual outside dimensions of the flattened round tubing was 0.13 inch $\times$0.031 inch (0.33 cm$\times$0.787 cm). The flattened tubing defines an opening for liquid coolant flow having a dimension of 0.050 inch $\times$0.23 inch (0.127 cm $\times$0.584 cm). A plurality of such tubes, pre-cut to the desired length, may be melt bonded or ultrasonically bonded to a thin, e.g., 0.005 inch thick (0.0127 cm) plastic ribbon 56 (FIG. 3), which may also be formed of polyethylene, to facilitate quick and accurate placement and spacing of the tubes 54 where coolant ducts are required. The tubes 54 may have a predetermined spacing formed between them, which spacing will be filled with liquid resin which is solidified during the winding process, or the tubes may be placed in contacting side-by-side relation to eventually create a single elongated cooling duct. Bonding of the resin used to insulate winding 32 to the material of tubing 54 is not necessary or important, as the plastic tubing will not become a permanent part of coil 13.

Figure 3:
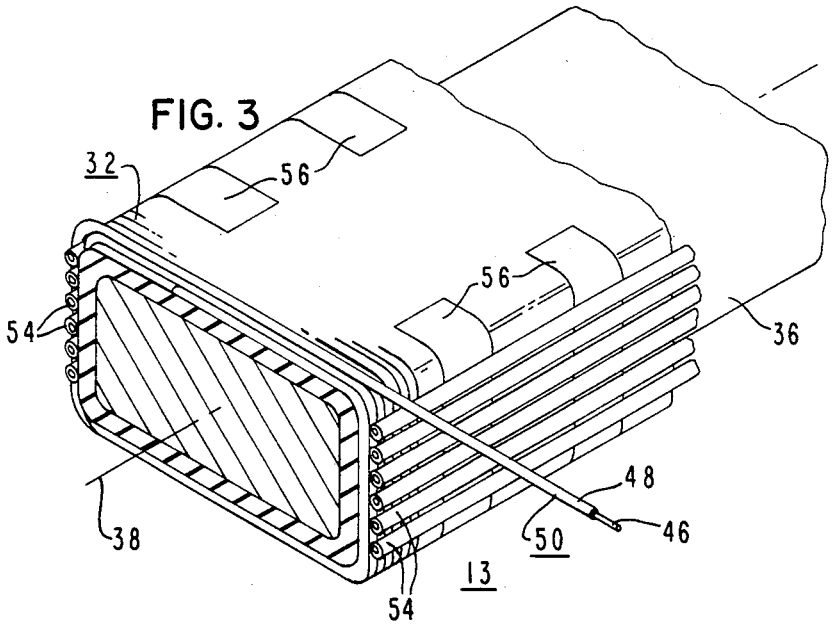
FIG. 3 is a perspective view which illustrates the step of adding plastic tubes to the winding being formed by the step shown in FIG. 2.

After the plastic tubes 54 have been secured to the winding layer, as shown in FIG. 3. the winding process continues as shown in FIG. 4, with one or more turn layers of winding 32 being applied over the plastic tubes 54. Additional cooling ducts may then be formed between turn layers, if desired, by repeating the steps shown in FIG. 3.

When coil 13 has been completed and assembled with magnetic core 18 to provide the core-coil assembly 12 shown in FIG. 1, the assembly 12 is disposed in tank 20 and immersed in the liquid 22. When the transformer 10 is energized by source 26 and connected to load 32, either during testing in the factory or during actual usage, the temperature of the windings of coil 13 will start to rise, thermal gradients will be produced in liquid 22, and the warm liquid will rise and the cooler liquid will fall, creating a thermal siphon flow of liquid 22 about coil 13 and also through the openings defined by the plastic tubes 55.

FIG. 5A is an enlarged cross-sectional view of coil 13, taken between arrows V—V in FIG. 1, illustrating the tubes 54 before dissolving in liquid 22. When liquid 22 reaches the point of solubility, which is approximately 75° C. for polyethylene, the tubes 54 dissolve in liquid 22 and the duct size increases to the outside dimensions of the tubes, forming the cooling ducts 60 shown in FIG. 5B. FIG. 5B is similar to the view shown in FIG. 5A except the tubes 54 have been dissolved to create the larger cooling ducts 60. The insulation 62 which defines the walls of the cooling ducts 60 is the cellulose-free liquid resinous insulation which has been applied in thin layer upon thin layer, with each thin layer being solidified before the next layer is applied as described in my incorporated co-pending application.

In summary, there has been disclosed new and improved methods of forming cooling ducts in the winding of an electrical transformer cooled by a liquid dielectric, which greatly simplifies the formation of such ducts without adding any permanent duct formers to the winding, and without adding a separate manufacturing step to remove duct formers. The duct formers which are utilized create relatively small flow paths for the liquid dielectric when the transformer is initially energized, and the flow paths increase in cross section as the flowing liquid dissolves the tubing, to enlarge the coolant ducts or flow paths to the outer dimensions of the tubes.

I claim as my invention:

1. A method of forming cooling ducts in the winding of an electrical transformer cooled by a liquid dielectric, comprising the steps of:

winding an electrical conductor to form an electrical winding having a plurality of conductor turns, placing plastic tubes in the electrical winding as its conductor turns are being formed, with said plastic tubes being formed of a material dissolvable in the liquid dielectric, forming a core-coil assembly, using the electrical winding, placing the core-coil assembly in a tank containing liquid dielectric, to form a liquid cooled electrical transformer, and dissolving the plastic tubes in the liquid dielectric.

2. The method of claim 1 wherein said dissolving step includes the step of energizing the electrical transformer to start thermal siphon flow of the liquid dielectric through the tubes.

3. The method of claim 1 wherein the step of placing plastic tubes in the electrical winding includes the steps of attaching the plastic tubes to plastic tape dissolvable in the liquid dielectric, and attaching the plastic tape to conductor turns of the electrical winding.

4. The method of claim 1 including the step of forming solid, non-cellulosic insulation about the plastic tubes, prior to the step of dissolving the plastic tubes in the liquid dielectric.

5. The method of claim 4 wherein the step of forming solid, non-cellulosic insulation includes the steps of applying thin layer upon thin layer of liquid resinous insulation to a substrate, and solidifying each layer in situ before the next layer is applied.

* * * * *